United States Patent [19]

Kondo et al.

[11] 4,259,559

[45] Mar. 31, 1981

[54] ILLUMINATED PUSH-BUTTON ELECTRICAL SWITCH ASSEMBLY

[75] Inventors: Shiro Kondo; Masao Kumagai, both of Furukawa, Japan

[73] Assignee: Alps Electric Co., Ltd., Tokyo, Japan

[21] Appl. No.: 139,713

[22] Filed: Apr. 14, 1980

[30] Foreign Application Priority Data

Apr. 19, 1979 [JP] Japan ..... 54/48290

[51] Int. Cl.[3] ..... H01H 9/00

[52] U.S. Cl. ..... 200/311; 200/314

[58] Field of Search ..... 200/311, 314, 310, 313, 200/308, 5 A

[56] References Cited

U.S. PATENT DOCUMENTS

| | | | |
|---|---|---|---|
| 3,336,456 | 8/1967 | Ploetz | 200/314 |
| 3,601,566 | 8/1971 | Hansen et al. | 200/314 |
| 3,715,548 | 2/1973 | Schadow | 200/311 |
| 3,855,959 | 12/1974 | Hinze | 200/308 |
| 3,855,961 | 12/1974 | Schadow | 200/308 |
| 3,969,609 | 7/1976 | Wanner et al. | 200/314 |

*Primary Examiner*—Willis Little

*Attorney, Agent, or Firm*—Guy W. Shoup; Gerard F. Dunne

[57] ABSTRACT

An illuminated push-button switch assembly has a casing slidably mounting a manipulation member provided at its exterior end with an indicating plate. A light source is mounted in the casing to illuminate the indicating plate. The switch assembly further has shutter means constituted by a filter member and a drive member. The filter member is rotatably supported at its one end on the casing, while the filter member is rotatably supported at its intermediate portion by the manipulation member. The free end of the drive member is engageable with the filter member at the portion of the latter near the axis of rotation. As the slider is moved by manual operation of the manipulation member, the drive member is rotated to cause a rotation of the filter, so that the state of illumination of the indicating plate is changed in accordance with the state of the push-button switch. A large displacement of the driving member and, hence, a large rotation angle of the filter member, is obtained even by a small stroke of the slider, thanks to a suitable selection of positions of the operating and supporting points.

5 Claims, 4 Drawing Figures

ILLUMINATED PUSH-BUTTON ELECTRICAL SWITCH ASSEMBLY

BACKGROUND OF THE INVENTION

The present invention relates to an illuminated push-button electrical switch assembly.

There have been proposed various types of illuminated push-button switch assemblies which light up upon being actuated. In these known push-button switch assemblies, however, the lamp normally does not become lit unless the push-button is depressed. It is, therefore, quite difficult to discern the position of the push-button in dark places such as the interior of an automobile.

Illuminated push-button electrical switch assemblies which can obviate the above described disadvantage of the prior art have been described in U.S. Patent Application Ser. No. 107,525, filed Dec. 27, 1979 and U.S. Patent Application Ser. No. 109,842 filed Jan. 7, 1980.

The push-button electrical switch assemblies of the abovementioned application have an indicator plate attached to the end of the push-button and a shutter means disposed between the indicator and the illumination lamp. The shutter means is driven upon depression of the push-button and the state of illumination of the indicator plate by the illuminating lamp is changed in accordance with the change in position of the shelter means.

The present invention aims at further improving the above-explained type of illuminated push-bottom electrical switch assembly by reducing the stroke of the push button.

SUMMARY OF THE INVENTION

It is, therefore, an object of the invention to provide an illuminated push-button electrical switch assembly having a reduced push button stroke.

It is another object of the invention to provide an illuminated push-button electrical switch assembly in which only one illuminating lamp need be used for a plurality of push-button switches.

It is still another object of the invention to provide an illuminated push-button electrical switch assembly which permits easy direction of the position of the push button even in dark places.

These and other objects, as well as advantageous features of the invention will become more clear from the following description of the preferred embodiment taken in conjunction with the accompanying drawings.

DESCRIPTION OF THE PREFERRED EMBODIMENT

Figure 1:
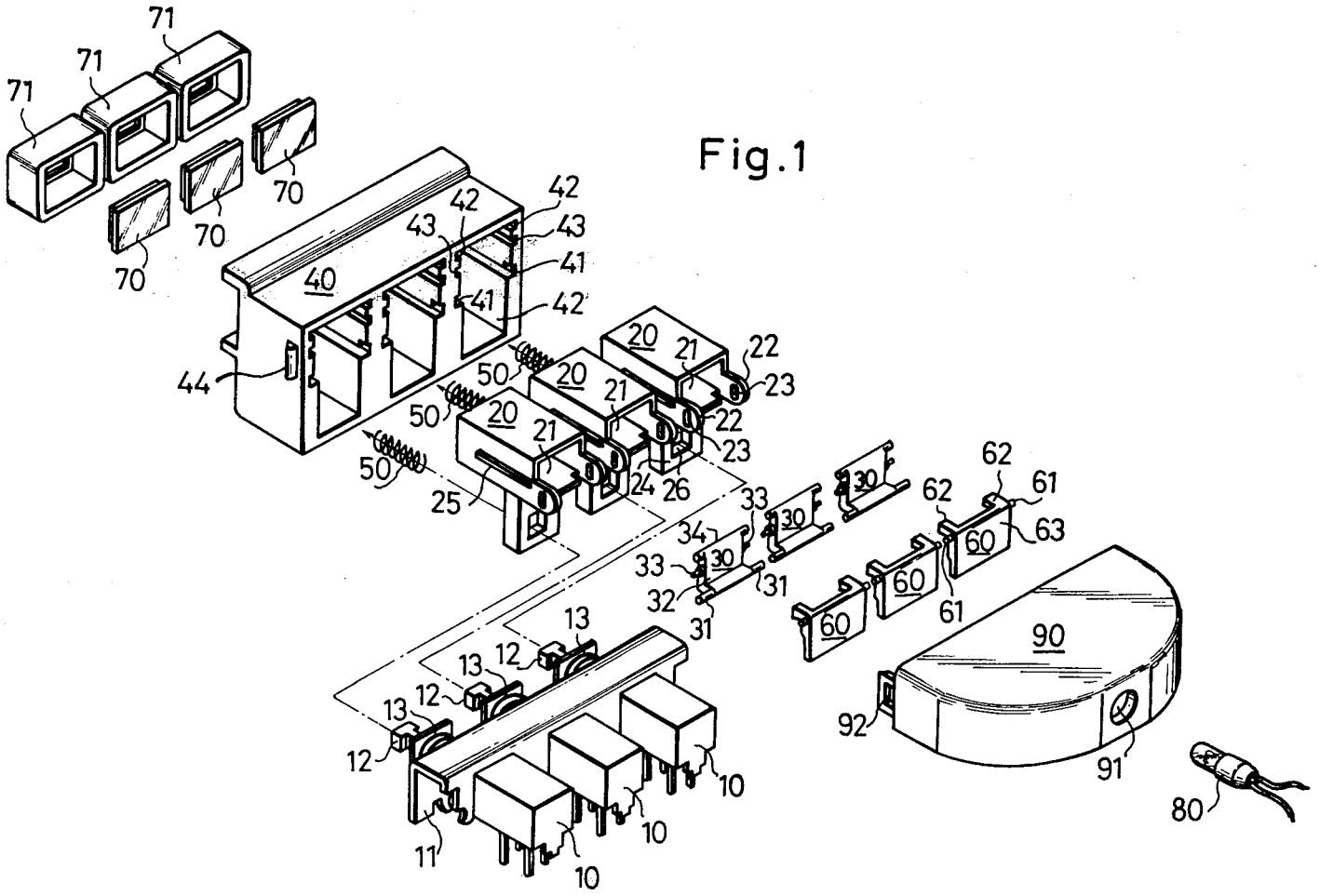
FIG. 1 is an exploded perspective view of an illuminated push-button electrical switch assembly in accordance with the invention.

Referring to the drawings, an illuminated push-button electrical switch assembly embodying the present invention has a plurality of push-button switches 10 attached to a frame 11 made of a metallic material. Reference numeral 12 denotes manipulation rods of each push button switch. These rods are adapted to be restored to their initial positions by means of a respective coiled springs 13. Also, a slider having a longitudinal bore 21 is designated by reference numeral 20. The slider 20 has side walls which each have a respective reward. projection 22. Vertically elongated bores 23 are formed in these rearward projections 22. A projecting pillar 24 adapted to be abutted by the manipulation rod 12 is provided on the lower portion of the slider 20, and guide projections 25 are formed on respective side surfaces of the slider 20. Reference numeral 30 denotes a driving rotary member made of a light-transmitting material, and is provided with supporting posts 31, a surface portion 32, columnar projections 33 provided on respective sides of the surface portion 32, and end portion 34. The supporting posts 31 are rotatably received by recesses 41 formed in the case 40 which will be described later, while the columnar projections 33 are engaged by the elongated bores 23.

The casing 40 has a plurality of rectangular bores 42 extending in the longitudinal direction. The casing 40 further has recesses 41 formed in the inner side surfaces above the rectangular bores 42 and a groove 43, as well as projections 44 formed on respective side walls thereof. Fitted into the upper part of each rectangular bore 42 is the aforementioned slider 20 with the guide projection 25 of the latter engaged in the groove 43. Also, a coiled spring 50 received by the lower part of the rectangular bore 42 is adapted to exert a biasing force which acts to press the columnar projection 24 of the slider 20 constantly against the manipulation rod of the switch 10.

Reference numeral 60 denotes a substantially L-shaped filter made of such a material that the light is transmitted or colored as it passes therethrough, e.g. an acrylic resin. Shafts 61 are formed on respective sides of the corner part of the L-shaped filter, and projecting arms 62 are formed on respective ends of one side of L-shape. Further, a surface portion 63 is formed on the other side of the L-shape. The shafts 61 are rotatably supported by recesses 43 of the casing 40. The filter 60 is so disposed that an upper edge 34 of the surface portion 32 of the aforementioned driving rotary body 30 abuts against the inner side of the L-shaped portion. Reference numeral 70 denotes a push-button knob made of a light-transmitting material or a semi-light-transmitting material transparent or colored to have any desired color. Reference numeral 71 denotes a knob holder which receives and clamps the push-button 70. Reference numeral 80 designates a lamp which is constantly lit.

A lamp holder designated at reference numeral 90 has an arcuate rear end portion. A recess 91 for retaining the lamp 80 is formed substantially at the center of the arcuate rear end portion. Recesses 92 adapted to be engaged by the projection 44 of the casing are formed at respective front side portions of the lamp holder 90.

In assembling the illuminated push-button electrical switch assembly of the invention, the coiled spring 50 is inserted into the lower portion of the rectangular hole 42 of the casing 40, and the slider 20 is inserted such that its guide projection 25 fits the groove 43 of the case 40. Subsequently, the knob holder 71 clamping the push-button knob 70 is attached to the slider 20, and the columnar projections 33 of the rotary driving body 30 are brought into engagement with the elongated holes 23 of the slider 55, while rotatably supporting the supporting posts 31 by the recesses 41 of the casing.

Thereafter, the shaft portions 61 of the filter 60 are rotatably fitted into the recesses 43 of the casing 40. Finally, the manipulating rod 12 of the switch 10 is inserted into the lower portion of the rectangular hole 42 of the casing 40 through a square bore 26 formed in the projecting pillar 24, and the switch frame 11 is fixed, for example, to the lamp holder 90 by suitable means which is not shown, thus completing the assembling of the illuminated push-button electrical switch assembly of the invention.

Figure 2:
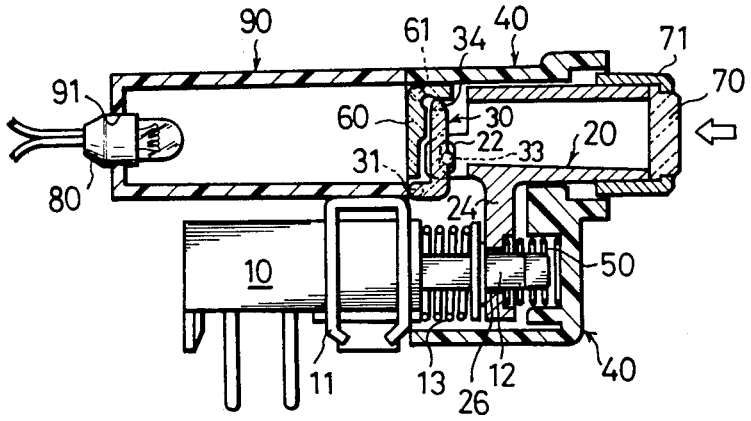
FIG. 2 is a sectional side elevational view of an illuminated push-button electrical switch assembly of the invention in the state before the depression of the push-button.
Figure 3:
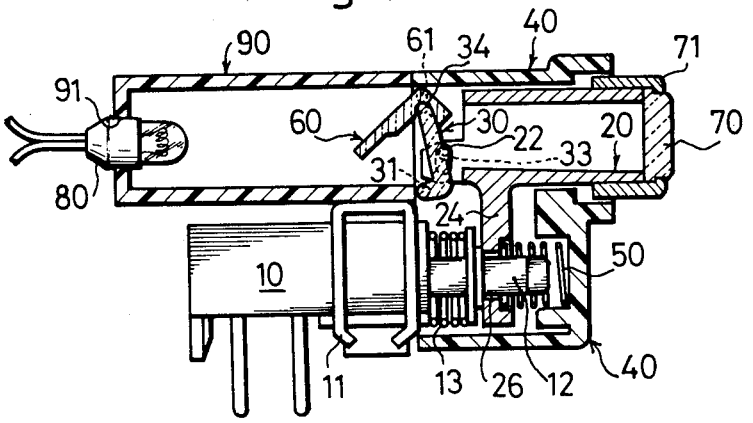
FIG. 3 is a sectional side elevational view of an illuminated push-button electrical switch assembly of the invention in the state in which the push-button switch is in the operating condition.
Figure 4:
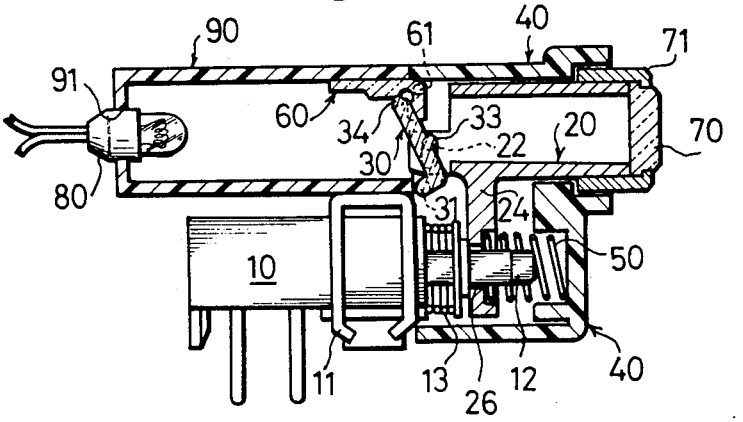
FIG. 4 is a sectional side elevational view of an illuminated push-button electrical switch assembly of the invention in the state in which the push-button is being depressed.

The illuminated push-button electrical switch assembly having the described construction operates in the manner described hereinunder, with specific reference to FIG. 2 to FIG. 4. More specifically, FIGS. 2, 3 and 4 show, respectively, the switch assembly in the status before depression of the push-button knob, during the depression of the push-button knob and after the depression of the same.

The slider 20 moves as the push-button knob 70 is depressed in the direction of the arrow 70, so that the driving rotary body 30, whose columnar projections 33 are received by the elongated holes 23 of the slider 20, is rotated around the axis of the supporting posts 31.

The distance between the supporting posts 31 and the columnar projections 33 is represented by A, whereas the distance between the columnar projections 33 and the end portion 34 is represented by B. If the distance B is greater than A, the displacement of the end portion 34 of the driving rotary member 30 is much greater than the stroke of the slider 20, due to the lever action.

In the vicinity of the shafts 61 which constitute the axis of rotation of the filter 60, the surface portion 63 of the filter 60 makes contact with the end portion 34 of the driving rotary drive 30. Therefore, as the end portion 34 rotates, the filter 60 rotates around the axes of the shafts 61 as shown in FIG. 3. As the slider 20 moves further, the filter 60 makes a full rotation as shown in FIG. 4, so that the projecting arms 62 emerge instead of the surface portion 63.

Thus, before the depression of the push-button, the light coming from the lamp 80 is applied, after passing through the surface portion 63 of the filter 60 to be colored, onto the push-button knob 70 to illuminate the latter in a certain color. However, after the depression of the push-button knob 70, the light of the lamp is directly applied to the push-button knob 70.

From the foregoing description, it will be understood that the filter 60 can be rotated without fail even by a small stroke of the switch 10, if the ratio of the distance A between the columnar projections 33 of the driving rotary body 30 and the supporting post 31 to the distance B between end portion 34 and the supporting posts 31, 31 is selected to be sufficiently large.

It is quite advantageous that a plurality of switches are illuminated by a single lamp.

In addition, the status of the switch such as the on or off state can be distinguished by the degree of brightness and change in tone of the color, as set forth more fully in the copending applications identified above.

Furthermore, the position of the switch can be discerned even in a dark place to permit easy manipulation, because the lamp is always lit.

In the described embodiment, the distance A is smaller than the distance B. This, however, is not limiting and it is possible to obtain a sufficiently large displacement of the end portion of the driving rotary body for a given stroke of the slider, if a large distance is preserved between the point at which the slider contacts the driving rotary body and the end of the latter.

What is claimed is:

1. An illuminated push-button electrical switch assembly comprising: a casing having a manipulation member mounted slidably therein, said manipulating member having an arm portion adapted to engage a manipulation rod of a push-button switch for movement therewith; an indicating plate mounted to an exterior end portion of said manipulation member; a light source held on said casing for illuminating said indicating plate; and shutter means constituted by a filter member and a drive member, said filter member being rotatably journalled at its one end on said casing, said driving member having a free end adapted to contact said filter member at a portion of the latter in the vicinity of axis of rotation of said filter member, said driving member being rotatably supported at its intermediate portion by said manipulation member.

2. An illuminated push-button electrical switch assembly as claimed in claim 1, wherein said filter member is colored to such an extent as to permit the light from said light source to pass therethrough, while said drive member is made of a light-transmitting material.

3. An illuminated push-button electrical switch assembly as claimed in claim 2, wherein said indicating plate is made of a light-transmitting material.

4. An illuminated push-button electrical switch assembly as claimed in claim 2, wherein said drive member is made of an acryl resin.

5. An illuminated push-button electrical switch assembly as claimed in claim 1, wherein said filter member has a reduced light transmitting factor so as to reduce the light passed therethrough, and is colored to such an extent as to permit the light from said filter member to pass therethrough.

* * * * *